US006155142A

United States Patent [19]

Bally et al.

[11] Patent Number: 6,155,142

[45] Date of Patent: Dec. 5, 2000

[54] PLIERS WITH FORCE AUGMENTATION AND SELF-ADJUSTMENT CAPABILITY

[75] Inventors: Alexander Bally, Pittsburgh; Eric R. Colburn, Wexford, both of Pa.

[73] Assignee: B!G Ventures, LLC, Pittsburgh, Pa.

[21] Appl. No.: 09/373,819

[22] Filed: Aug. 13, 1999

[51] Int. Cl.[7] ..... B25B 7/04

[52] U.S. Cl. ..... 81/389; 81/91.1; 81/426

[58] Field of Search ..... 81/91.1, 91.3, 81/355, 368, 370, 375, 426, 452, 454, 389

[56] References Cited

U.S. PATENT DOCUMENTS

| | | | |
|---|---|---|---|
| 1,207,064 | 12/1916 | Metcalf . | |
| 2,375,082 | 12/1943 | Colley . | |
| 2,595,368 | 6/1948 | Plautz . | |
| 2,694,331 | 11/1954 | Meredith | 81/91.1 |
| 2,731,124 | 1/1956 | Kaplanowski . | |
| 2,906,155 | 9/1956 | Miller . | |
| 3,091,841 | 7/1961 | Wurzel . | |
| 3,232,152 | 2/1966 | Miller . | |
| 3,306,143 | 2/1967 | Ortman | 81/368 |
| 3,600,986 | 8/1971 | Baldwin, Jr. | 81/370 |
| 4,353,240 | 10/1982 | Undin et al. | 72/410 |
| 4,499,797 | 2/1985 | Wilson | 81/367 |
| 4,651,598 | 3/1987 | Warheit . | |
| 5,060,543 | 10/1991 | Warheit | 81/409 |
| 5,351,585 | 10/1994 | Leseberg et al. | 81/426 |
| 5,427,004 | 6/1995 | Monaco | 81/91.3 |
| 5,609,080 | 3/1997 | Flavigny . | |
| 6,012,361 | 1/2000 | Wooster, Jr. et al. | 81/367 |
| 6,012,362 | 1/2000 | Wang | 81/368 |
| 6,026,716 | 2/2000 | Orlosky | 81/360 |

*Primary Examiner*—Stephen F. Gerrity
*Assistant Examiner*—Hadi Shakeri
*Attorney, Agent, or Firm*—David C. Jenkins; Eckert Seamans Cherin & Mellott, LLC

[57] ABSTRACT

The invention includes pliers with self-adjustment capability for applying an initial grasping force to a workpiece and for augmenting the initial grasping force applied to the workpiece. The pliers are structured such that angular displacement of a handle portion of a first plier member is smaller than angular displacement of a jaw portion of the first plier member during an initial movement of the handle portions toward each other for applying the initial grasping force to the workpiece. In addition, the pliers are structured such that angular displacement of the handle portion of the first plier member is larger than angular displacement of the jaw portion of the first plier member to permit augmenting of the initial grasping force applied to the workpiece during a continued movement of the handle portions toward each other.

35 Claims, 11 Drawing Sheets

PLIERS WITH FORCE AUGMENTATION AND SELF-ADJUSTMENT CAPABILITY

BACKGROUND OF THE INVENTION

1. Field of the Invention

The present invention relates generally to utility pliers and, more particularly, to pliers that self-adjust for applying an initial grasping force to a workpiece and for augmenting the initial grasping force applied to the workpiece.

2. Description of the Prior Art

Many types of handheld utility pliers are known in the art. Conventional pliers typically include two plier members interconnected in a scissor-like arrangement allowing for a workpiece to be grasped by jaw portions of the pliers in response to movement of handle portions of the pliers. Over the years, numerous improvements have been made to the conventional plier design in order to obtain better and more efficient pliers. For example, self-adjusting pliers have been developed in order to provide a set of pliers that more easily and automatically adjust to the size of a given workpiece. However, while such pliers provide adjustment capability, they do not provide active augmentation of clamping force beyond what conventional pliers provide.

A limitation of conventional plier designs is that there is an absolute limit to how close the pivot point can be moved toward the jaws, which also limits the amount of mechanical advantage a user has for applying force to a workpiece. Furthermore, in conventional pliers the handles and jaws are coupled in a fixed relationship, typically using the scissor-like arrangement as described, such that the jaws converge on a workpiece at essentially the same rate as the handles when a user applies hand pressure to the pliers. This type of fixed relationship between the handles, the jaws and the pivot point limits the amount of force that a user can apply to a workpiece and produces an undesirable trade-off between overall handle separation and gripping force being applied to a workpiece. Specifically, the longer the handles the greater the leverage and hence the greater the gripping force that can be applied to the workpiece. However, longer handles are impractical and make use of the pliers more inconvenient because either the handles are too far apart to be conveniently grasped by one hand, or the small jaw opening limits the range of adjustability of the jaws.

U.S. Pat. No. 5,832,793 discloses an adjustable wrench having a movable handle and a movable jaw for adjusting the wrench to grip objects of various sizes. While this wrench provides some degree of increased mechanical advantage as well as adjustability for grasping variously-sized workpieces, size adjustment is not automatic and requires discrete manipulations using two hands.

U.S. Pat. No. 2,144,180 discloses adjustable pliers where the handles and jaws are arranged other than in the typical scissor-like arrangement. While these pliers do allow for a level of size adjustment, the function is not provided in a seamless, one-handed operation. These particular pliers require a user to re-position his hand for each step of operation.

Many other types of pliers having handles and jaws coupled in a fixed relationship that limits the amount of force that a user can apply to an object are known. For example, U.S. Pat. No. 4,651,598 discloses utility pliers that provide for self-adjustment through employment of a spring-biased control arm positioned between the handles. In this particular hand tool the range of size adjustability within the envelope of acceptable handle spacing is limited because a large portion of the available handle movement is taken up with moving the jaws up against the workpiece from the fully open rest position. This leaves only a minor portion of available handle movement for carrying out the crucial task of workpiece compression. In addition, U.S. Pat. Nos. 3,232,152, 2,906,155 and 1,651,216 disclose adjustable pliers which utilize the concept of shifting pivot points between first and second pivot means positioned at different locations on the pliers.

U.S. Pat. No. 5,609,080 discloses another type of pliers which is similar to the well known VISE-GRIP type pliers. Such pliers are typically not considered self-adjusting because they must be initially adjusted to set the opening of the jaws in relation to the workpiece to be grasped.

There remains a need for improved handheld utility pliers which provide the capability of applying a greater force to an object being gripped by the pliers and which can be easily operated by the user, preferably with one hand.

SUMMARY OF THE INVENTION

The present invention has met the above-described needs by providing for improved pliers with force augmentation and self-adjustment capability.

Pliers with self-adjustment capability for applying an initial grasping force to a workpiece and for augmenting the initial grasping force applied to the workpiece include a first plier member having a handle portion, a jaw portion, an intermediate portion, and a link member interconnecting the handle portion of the first plier member to the intermediate portion of the first plier member. Also provided is a second plier member having a handle portion, a jaw portion, an intermediate portion therebetween, and a generally arcuate rack formed on the intermediate portion thereof.

The pliers also include a first pivot preferably having a positioning slot with a generally arcuate portion and a shifting slot portion formed in the intermediate portion of the first plier member and a pivot member formed on the second plier member where the pivot member is movable within the positioning slot. The first pivot permits the jaw portions to converge in response to initial movement of the handle portions toward each other for applying the initial grasping force to the workpiece.

The pliers further include a second pivot defined by locking surfaces formed on a generally arcuate rack and a rack engaging structure connected to the first plier member. The second pivot permits further convergence of the jaw portions in response to continued movement of the handle portions toward each other for augmenting the grasping force applied to the workpiece. The rack engaging structure is out of engagement with the locking surfaces of the generally arcuate rack while the jaw portions converge on the workpiece during the initial movement of the handle portions toward one another. The rack engaging structure moves into engagement with the locking surfaces of the generally arcuate rack in response to the continued movement of the handle portions toward each other.

The pliers also include a first biasing spring structured to bias the pivot member toward the shifting slot portion of the positioning slot. The pivot member is movable from the shifting slot portion toward the generally arcuate portion of the positioning slot against the bias of the first biasing spring during the continued movement of the handle portions toward each other. Furthermore, movement of the pivot member toward the generally arcuate portion of the positioning slot causes the rack engaging structure to move into engagement with the locking surfaces of the generally arcuate rack so that the second pivot permits the augmenting of the initial grasping force during the continued movement of the handle portions toward each other.

Advantageously, the described structure of the pliers of the invention is such that angular displacement of the handle portion of the first plier member is smaller than angular displacement of the jaw portion of the first plier member during the initial movement of the handle portions toward each other while angular displacement of the handle portion of the first plier member is larger than angular displacement of the jaw portion of the first plier member to permit the augmenting of the initial grasping force during the continued movement of the handle portions toward each other. Advantageously, this arrangement allows for augmenting of the initial grasping force that is initially applied to the workpiece to initially grasp the workpiece.

The pliers may also include a second biasing spring for biasing the handle portions away from each other and the jaw portions away from each other.

In another embodiment of the pliers of the invention, the first plier member includes a handle portion, a jaw portion, an intermediate portion, wherein the handle portion of the first plier member is formed separately from the intermediate portion of the first plier member and includes an integrally formed extension having a cam surface for cooperating with a cam follower formed on the intermediate portion of the first plier member. Preferably, the cam follower is formed on the intermediate portion of the first plier member adjacent the shifting slot portion of the positioning slot.

It is, therefore, an object of the present invention to provide pliers for grasping workpieces of different sizes.

It is also an object of the present invention to provide pliers which have enhanced mechanical advantage.

It is another object of the present invention to provide pliers that lessen the effort and strain on a worker's hand and thereby improve his or her safety and productivity.

It is a further object of the present invention to provide pliers that can be easily and efficiently operated.

It is yet another object of the present invention to provide pliers that can be operated with one hand.

It is another object of the present invention to provide pliers with force augmentation and self-adjustment capability that are capable of applying an initial grasping force to a workpiece and also capable of augmenting the initial grasping force applied to the workpiece.

It is still yet another object of the present invention to provide pliers where the handles and jaws of the pliers are coupled in such a manner that angular displacement of the handles is smaller than angular displacement of the jaws during initial movement of the handle portions toward each other as the jaws self-adjust to the workpiece, and wherein angular displacement of the handles is larger than angular displacement of the jaws to permit augmenting of the initial grasping force during continued movement of the handle portions toward each other.

These and other objects of the invention will be more fully understood from the following description of the invention with reference to the drawings appended hereto.

DESCRIPTION OF THE PREFERRED EMBODIMENT

Figure 1:
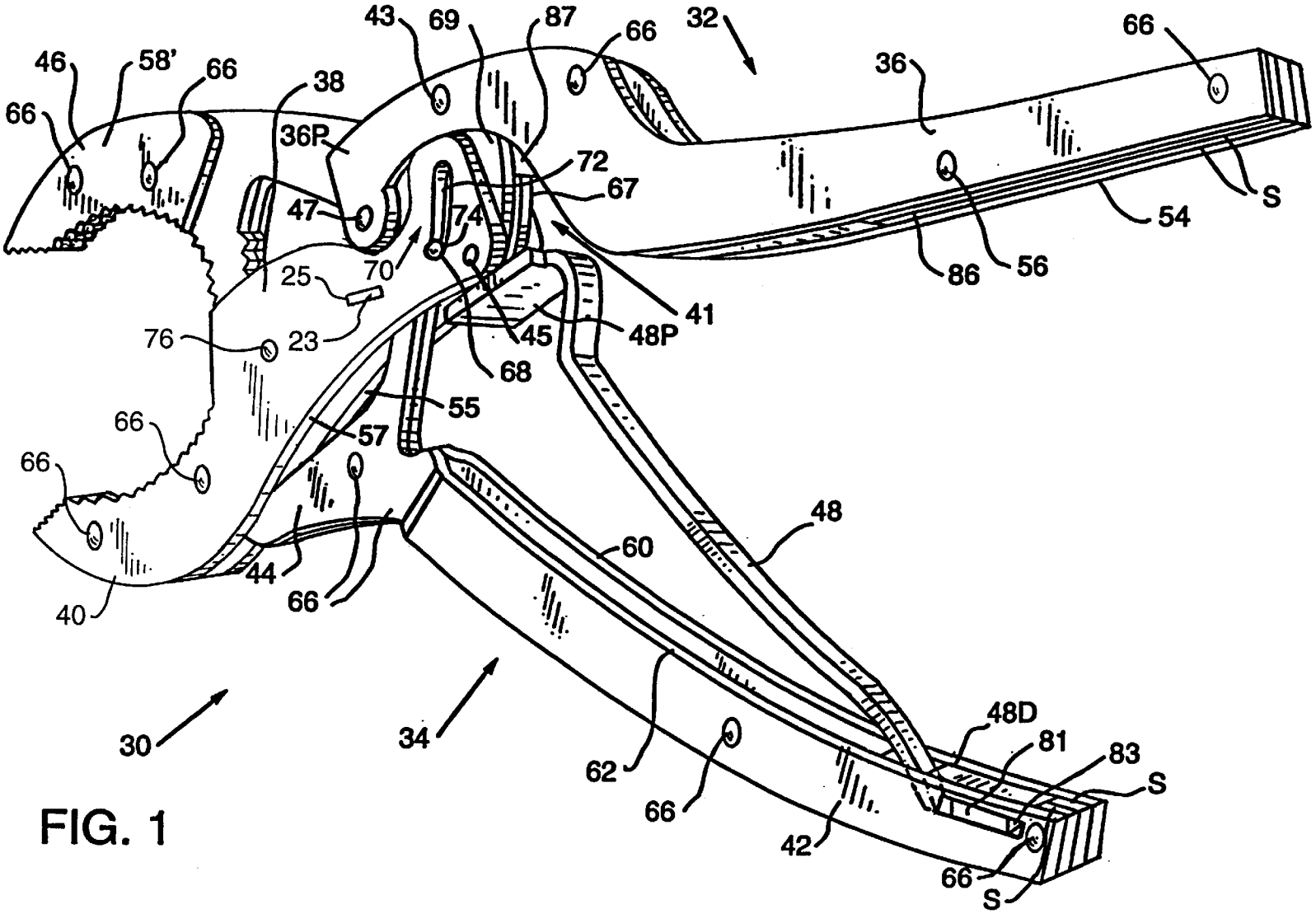
FIG. 1 is a perspective view of a preferred embodiment of the pliers of the present invention.
Figure 2:
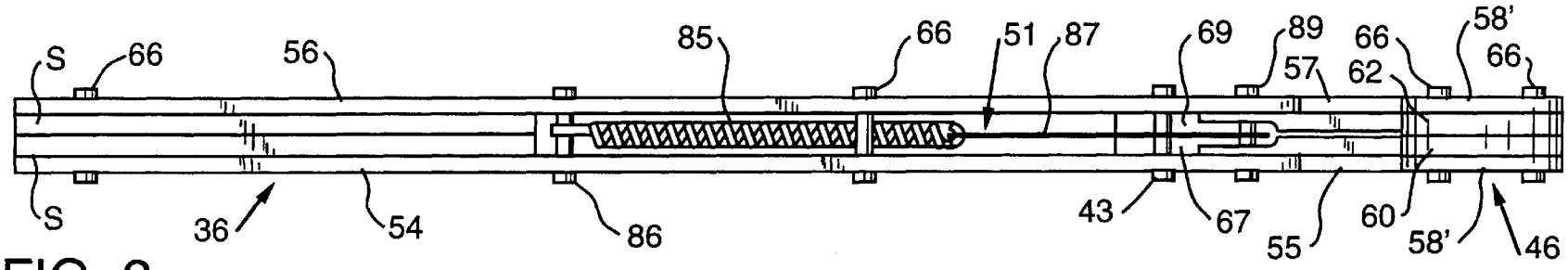
FIG. 2 is a top view of the pliers shown in FIG. 1.
Figure 3:
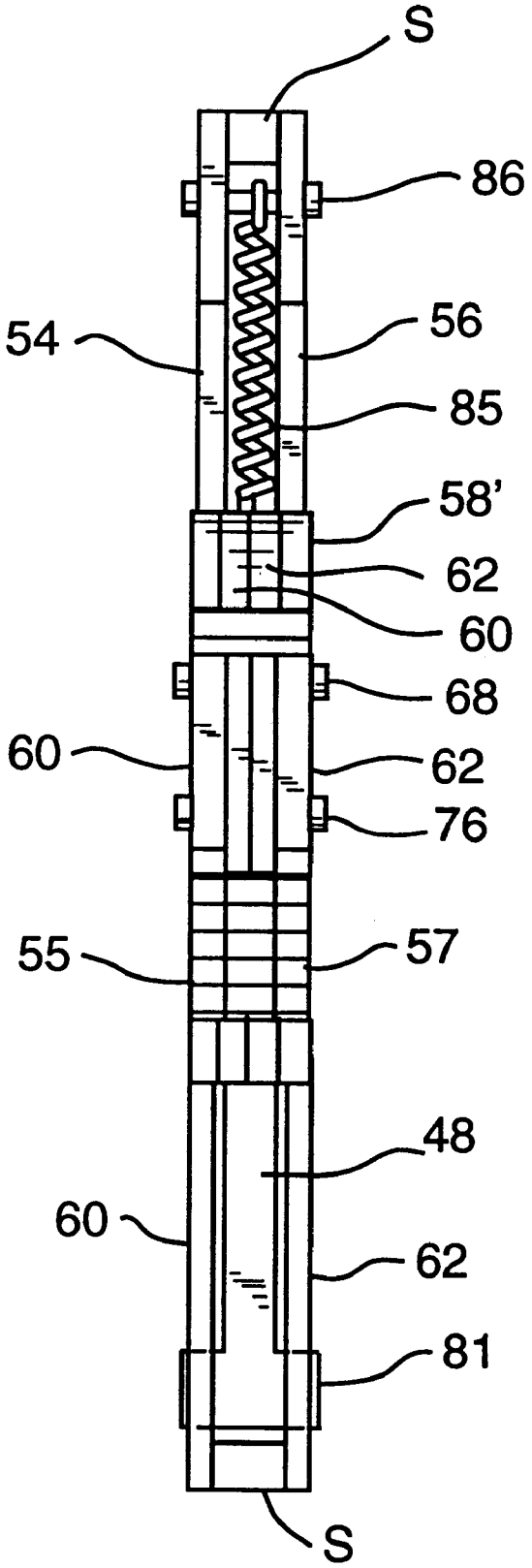
FIG. 3 is a front view of the pliers shown in FIG. 1.

Referring to FIGS. 1–6, there is shown a preferred embodiment of the pliers 30 of the present invention. The pliers 30 are capable of applying an initial grasping force to a workpiece W and of augmenting the initial grasping force applied to the workpiece W.

As used herein, the term "initial grasping force" means the force a user can initially apply to a workpiece by hand pressure on the handles of the pliers and is a function of the mechanical advantage that can be obtained when the pivot point is as close to the jaws as practical and the handles are as long as practical. Most conventional pliers and self-adjusting pliers offer about the same relationships between the jaw and handle portions to the pivot point and thus offer essentially no difference in the maximum initial grasping force a user can apply to a workpiece.

As used herein, the term "augmenting the initial grasping force" means actively multiplying or augmenting the initial grasping force a user can apply to a workpiece beyond what is possible with conventional pliers and self-adjusting pliers. It provides enhanced mechanical advantage and allows a user to grasp a workpiece with much greater force than possible with conventional pliers or self-adjusting pliers for a given amount of hand pressure against the handles.

As used herein, the term "angular displacement" means angle of rotation of the handles and the jaws of the pliers about their respective pivot points as the handles are moved toward each other and the jaws are moved toward each other.

In the present invention, force augmentation is accomplished by articulating at least one of the elements that comprise a handle and a jaw by interposing, for example, a linkage between handle and jaw so that the relative movement between them is either accelerated or decelerated. This linkage can be configured to multiply and augment the initial grasping force exerted on a workpiece by the jaws for a given hand force applied to the handles, as described in more detail below. Other arrangements, as disclosed herein, may also be provided for achieving force augmentation. It will be appreciated following a review of the description set forth herein and the drawings that the invention provides pliers that lessen the effort and strain on a worker's hand and thereby improve his or her safety and productivity.

The pliers 30 include a first plier member 32 and a second plier member 34 interconnected, as will be described in detail herein, in order to easily and efficiently adjust to the size of a given workpiece in order to initially grasp the workpiece and apply an initial grasping force thereto and to augment the initial grasping force applied to the workpiece. The first plier member 32 includes a handle portion 36, an intermediate portion 38, a jaw portion 40 and a link means, generally designated by reference numeral 41, for interconnecting the handle portion 36 and the intermediate portion 38. Preferably, the link means 41 is pivotally connected to the handle portion 36 and is pivotally connected to the intermediate portion 38. The second plier member 34 includes a handle portion 42, an intermediate portion 44 and a jaw portion 46.

The first plier member 32 and second plier member 34 are preferably formed of laminated construction. As shown best in FIGS. 1–3, the first plier member 32 includes relatively spaced apart first and second outer laminations 54 and 56 which form the handle portion 36. The intermediate portion 38 and the jaw portion 40 are also formed from first and second laminations 55 and 57. Inner lamination 58 may be provided on the jaw portion 40 between the laminations 55 and 57 to fill the gap between the laminations 55 and 57.

The second plier member 34 includes first and second laminations 60 and 62 that form the handle portion 42, the intermediate portion 44 and the jaw portion 46. As shown in the accompanying Figures, the assortment of laminations which make up the first plier member 32 and the second plier member 34 of the pliers 30 are constructed and arranged such that relative movement between the first plier member and the second plier member 34 enable an initial grasping force to be applied to the workpiece and for augmenting of the initial grasping force applied to the workpiece. It will be appreciated that the assortment of laminations described herein may be positioned or layered in various arrangements, other than as shown, to form the pliers 30. For example, the pliers 30 may be constructed with laminations 54, 56 and 55, 57 in the center and laminations 60, 62 positioned external thereto. Outer laminations 58' may be provided to extend the width of the jaw 46 to be equal to the width of the jaw 40.

The link means 41 includes link members 67, 69. The link members 67, 69 are preferably positioned between the laminations 55, 57 that form the intermediate portion 38 of the first plier member 32 and between the laminations 54, 56 which form the handle portion 36 of the first plier member 32. Specifically, the link members 67, 69, which are preferably identical, are pivotally connected at one end by a pin 43 to the handle portion 36 and are pivotally connected at another end to the intermediate portion 38 by a pin 45. The operation of the link members 67, 69 in relation to operation of the pliers 30 will be described in more detail herein.

The assortment of laminations described herein are preferably interconnected by a plurality of pins or rivets 66, in a manner as is generally known in order to retain the laminated construction of the pliers 30 together. The laminations are preferably blanked, stamped or laser-cut from heat-treatable sheet steel or high-grade or high-carbon steel. Handle grip covers (not shown) and internal spacers S to fill the gaps between laminations may be provided on the handle portions. The pliers 30 can also be manufactured using forged steel, structural plastics, fiber reinforced composite materials or combinations thereof.

The pliers 30 include first pivot means formed on the intermediate portions 38 and 44 to permit the jaw portions 40 and 46 to converge on a workpiece and apply an initial grasping force to the workpiece in response to an initial movement of the handle portions 36 and 42 toward each other. The pliers 30 also include second pivot means on the intermediate portions 38 and 44 to permit further convergence of the jaw portions 40 and 46 in response to continued movement of the handle portions 36 and 42 toward each other for augmenting the initial grasping force applied to the workpiece. Preferably, the second pivot means is positioned closer to the jaw portions 40 and 46 than the first pivot means so that a greater mechanical advantage may be obtained when using the pliers 30.

With particular reference to FIGS. 1 and 4–6, the first and second pivot means will be explained in more detail. The first pivot means includes a pivot member or pivot pin 68 on the intermediate portion 44 of the second plier member 34. The pivot pin 68 may be loosely trapped between the laminations 60, 62 or may be attached to the intermediate portion 44, for example, by mechanical interference fit, by providing a grooved center section of pivot pin 68 (not shown), by spring action if pivot pin 68 is a rolled spring pin (not shown), or by welding or other means which are generally known in the art. The first pivot means further includes a positioning slot 70 formed in the intermediate portion 38 of the first plier member 32. It will be appreciated that the positioning slot 70 is formed on both the first and second laminations 55 and 57. The positioning slot 70 includes a generally arcuate portion 72 and a shifting slot portion 74 in communication with the generally arcuate portion 72. The pivot pin 68 is movable and slidably received in the positioning slot 70.

The second pivot means includes a pawl 75 pivotally secured by a pivot pin 76 to the intermediate portion 38 of the first plier member 32. The pliers 30 also include a generally arcuate rack 78 formed on the intermediate portion 44 of the second plier member 34. The rack 78 includes a plurality of teeth 79 and the pawl 75 also includes one or more teeth 77 formed on a side thereof adjacent the plurality of teeth 79 formed on the rack 78. It will be appreciated that the teeth 79 define locking surfaces formed on the rack 78 and that the teeth 77 formed on the pawl 75 are positioned for cooperation with the teeth 79.

Figure 4:
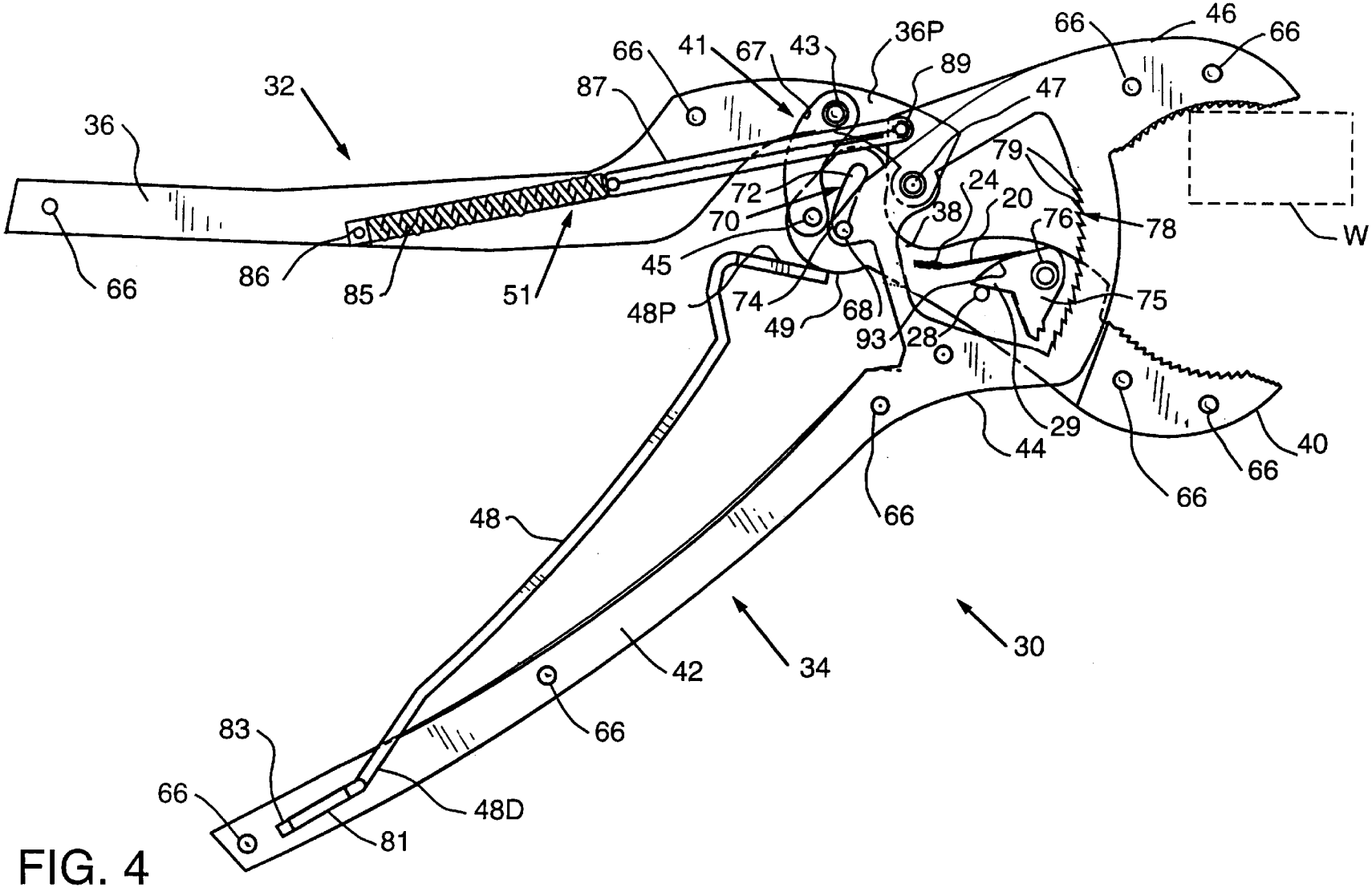
FIG. 4 is a simplified side elevational view of the pliers shown in FIG. 1 in a fully open position.
Figure 4A:
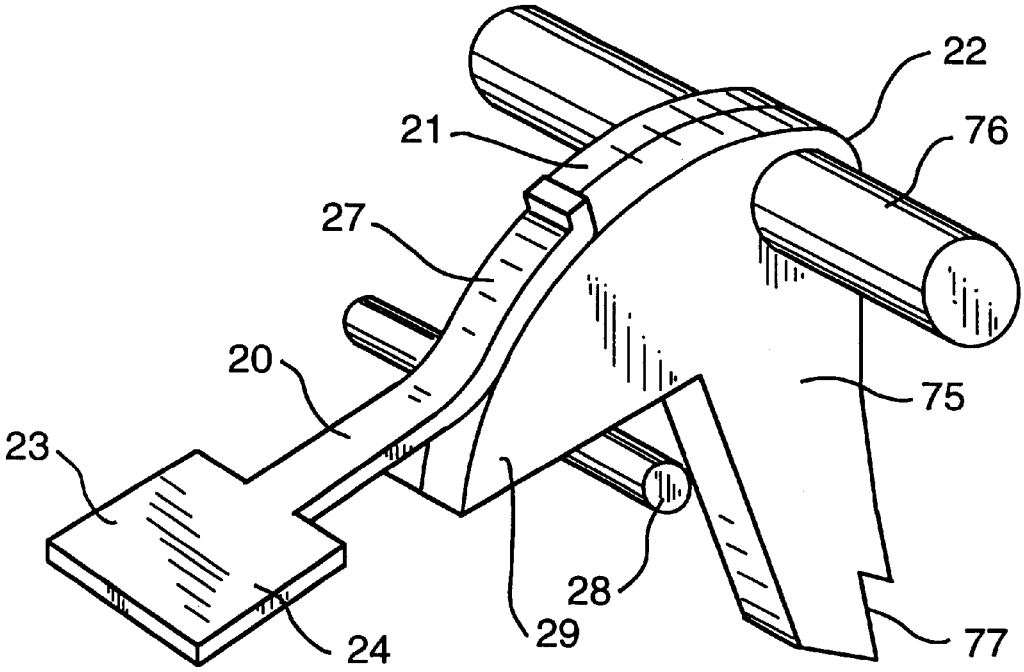
FIG. 4*a* is a perspective view of a preferred pawl arrangement utilized with the pliers shown in FIG. 1.

As best shown in FIG. 4*a*, also provided are spring means, such as leaf spring 20 secured to the intermediate portion 38 of the first plier member 32 for urging the pawl 75 into a generally concentric relationship with the rack 78 during the initial movement of the handle portions 36 and 42 toward each other to apply an initial grasping force to the workpiece and for urging the teeth 77 of the pawl 75 into engagement with the teeth 79 of the rack 78 during the continued movement of the handle portions 36 and 42 toward each other for augmenting the initial grasping force. The pawl 75 includes a top surface 21, a bearing surface 22 formed on the same side of the pawl 75 as the teeth 77 and a pawl extension 29 for cooperating with pawl stop pin 28. Preferably, the bearing surface 22 is formed adjacent the top surface 21 of the pawl 75. It will be appreciated that the pawl 75 may be a single member constructed and arranged to operate between the outer laminations 55 and 57 of the first plier member 32 or may be multiple members constructed and arranged to operate in conjunction between the laminations 55 and 57. It will be further appreciated that whether the pawl 75 is of single or multiple member construction, the pawl 75 must remain capable of movement with respect to the first plier member 32.

The leaf spring 20 includes a first end having laterally extending tabs 23 and 24 for receipt in notches 25 and 26, respectively, that are formed on the intermediate portion 38 of the first plier member 32. The leaf spring 20 also includes a second end 27 positioned for cooperating with the top surface 21 of the pawl 75 during the urging of the pawl 75 into a concentric relationship with the rack. The second end 27 of the leaf spring 20 is also positioned for cooperating with the pawl 75 during the urging of the teeth 77 into engagement with the teeth 79. The leaf spring 20 impinges on the top surface 22 of the pawl 75 to bias the lower side of the pawl extension 29 into contact with pin 28 such that the teeth 77 of pawl 75 are out of engagement with teeth 79 of rack 78 while the first pivot pin 68 is seated in the shifting slot portion 74 of positioning slot 70 when the handle portions 36 and 42 and jaw portions 40 and 46 converge on a workpiece in order to self-adjust and apply an initial grasping force on the workpiece.

During operation of the pliers 30, the leaf spring 20 keeps the pawl 75 in a fixed relationship to the rack 78 when the pliers 30 are not contacting a workpiece. When a workpiece is encountered and the pivot pin 68 is forced out of the shifting slot portion 74 of the positioning slot 70, the pawl 75 is forced toward the rack 78. When the bearing surface 22 of the pawl 75 contacts the rack 78, it forces the pawl 75 to pivot its teeth 77 toward engagement with the teeth 79. As the teeth 77 and 79 engage and the handle portions 36 and 42 are further squeezed together, the pawl 75 is fully engaged in the rack 78 while the intermediate portion 38 and the leaf spring 20 continue to rotate about the pivot pin 76. The leaf spring 20, and more particularly, the second end 27 thereof, cooperates with the top surface 21 of the pawl 75 to keep pressure on the pawl 75 biasing it toward engagement with the rack 78. Meshing of the teeth 77 and 79 causes the lower side of pawl extension 29 to be lifted away from contact with pin 28 against the bias of the leaf spring 20. Leaf spring 20 maintains teeth 77 and 79 in positive engagement while the further clamping force is applied to the workpiece to apply force augmentation to the workpiece and, after use, returns pawl 75 into a disengaged position where the lower side of pawl extension 29 is again in contact with pin 28 to cause pawl teeth 77 to be disengaged from rack teeth 79 and allow pliers 30 to return to the original, fully open position.

It will be appreciated that the pawl arrangement described herein, and specifically the leaf spring 20 for cooperating with the pawl 75, provides a simple and efficient mechanical means for maintaining the pawl 75 in a concentric relationship with the rack 78. It will also be appreciated that leaf spring 20, as shown, is for illustrative purposes only and that other configurations and arrangements for such a spring means may be provided in accordance with the present invention.

The generally arcuate portion 72 of the positioning slot 70 has a curvature generally centered about the pivot pin 76 which mounts the pawl 75. In addition, the generally arcuate rack 78 has a curvature generally centered about the pivot pin 68. The relative movement of the first plier member 32 and the second plier member 34 against each other are therefore controlled by the precise geometry of defined pivot points and corresponding arcs. This approach allows tight tolerances and precise, predictable and repeatable adjustment in grasping action with minimal looseness in the pliers 30.

The pliers 30 also include a biasing spring, such as leaf spring 48 structured to bias the pivot pin 68 toward the shifting slot portion 74 of the positioning slot 70 as the pivot pin 68 is movable from the shifting slot portion 74 toward the generally arcuate portion 72 of the positioning slot 70 against the bias of the leaf spring 48 during the continued movement of the handle portions 36 and 42 toward each other. Specifically, the intermediate portion 38 of the first plier member 36 includes a bearing surface 49 where a proximal end 48P of the leaf spring 48 acts against the bearing surface 49 to bias the pivot pin 68 toward the shifting slot portion 74 of the positioning slot 70. A distal end 48D of the leaf spring 48 is attached to a distal end of the handle portion 42 of the second plier member 34 by, for example, tabs 81 formed on the distal end of the leaf spring 48 extending through slots 83 formed in the laminations 60 and 62 which form the handle portion 42 of the second plier member 34. Alternatively, the leaf spring 48 may be attached to the distal end of the handle portion 42 by, for example, pins or rivets (not shown) extending through the handle and the distal end of the leaf spring 48 or other suitable means.

The bearing surface 49 is generally arcuate and has a curvature generally centered about a center point of the pivot pin 68 when the pivot pin 68 is positioned in the shifting slot portion 74 of the positioning slot 70.

A further biasing means, such as generally designated by reference numeral 51, may be provided for biasing the handle portions 36 and 42 away from each other and the jaw portions 40 and 46 away from each other to maintain the pliers 30 in a fully open position (as shown in FIG. 4) or to return the pliers 30 to a fully open position following operation of the pliers 30. The biasing means may include, for example, an extension spring 85 attached at one end by a pin 86, or other suitable means, to the handle portion 36 of the first plier member 32. The other end of the spring 85 may be hooked to a spring link 87 or other suitable means. The opposing end of the spring link 87 is in turn attached by a pin 89 to the intermediate portion 44 of the second plier member 34. Preferably, the spring link 87 is a rigid member that is constructed and arranged for cooperation with the spring 85 for biasing the handle portions 36 and 42 away from each other and the jaw portions 40 and 46 away from each other. The spring means 51 is preferably positioned between the link members 67, 69 and the laminations 54 and 56 which form the handle portion 36 of the first plier member 32. This arrangement allows for operation of the pliers 30 without the biasing means 51 interfering with the operation of the various elements of the pliers 30. In addition, other types of springs located at various locations on the pliers 30 may be provided for performing essentially the same function, as will be recognized by one of ordinary skill in the art.

Figure 5:
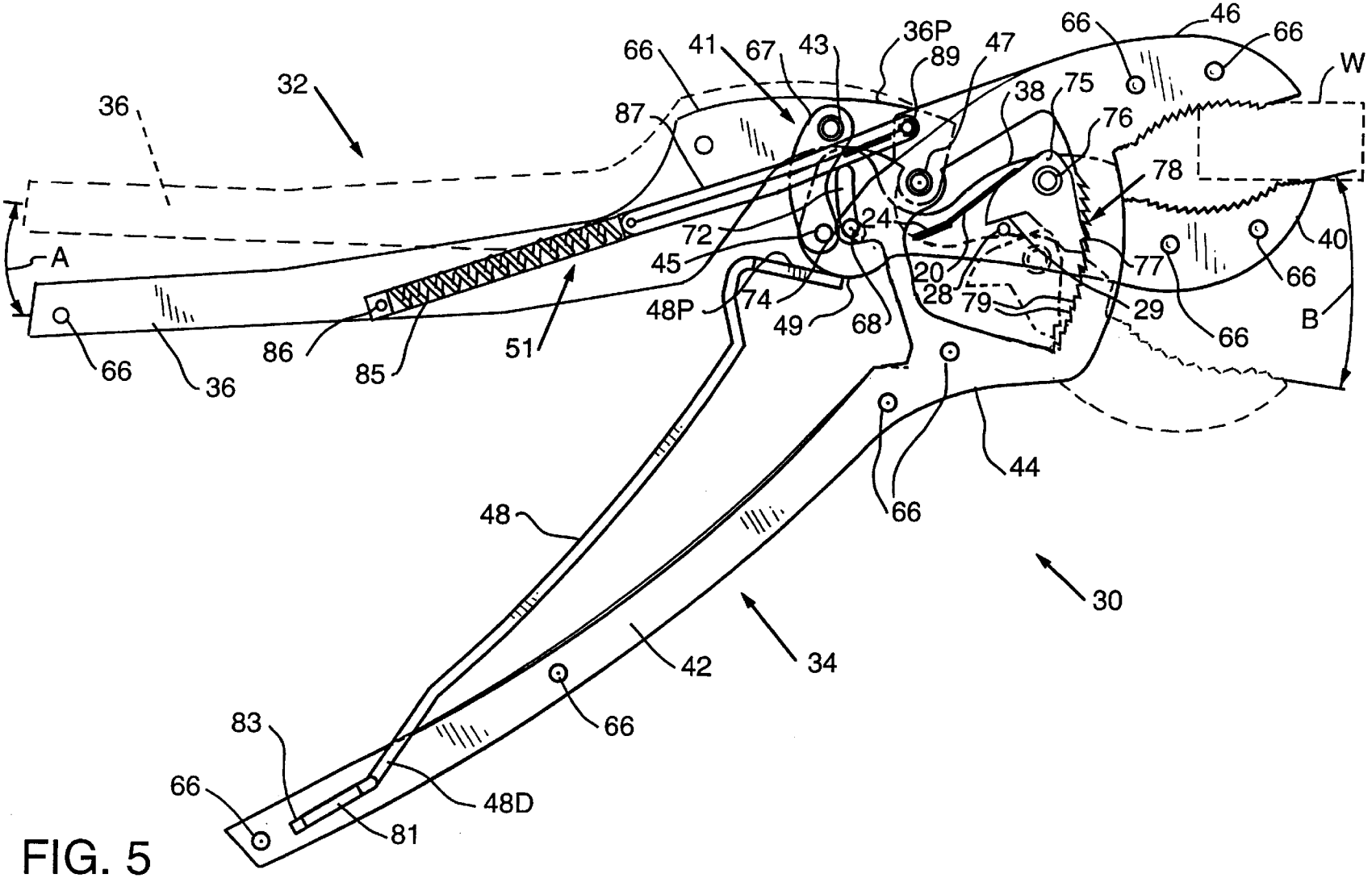
FIG. 5 is a further side elevational view of the pliers shown in FIG. 4 with the pliers being operated to initially grasp a workpiece.
Figure 6:
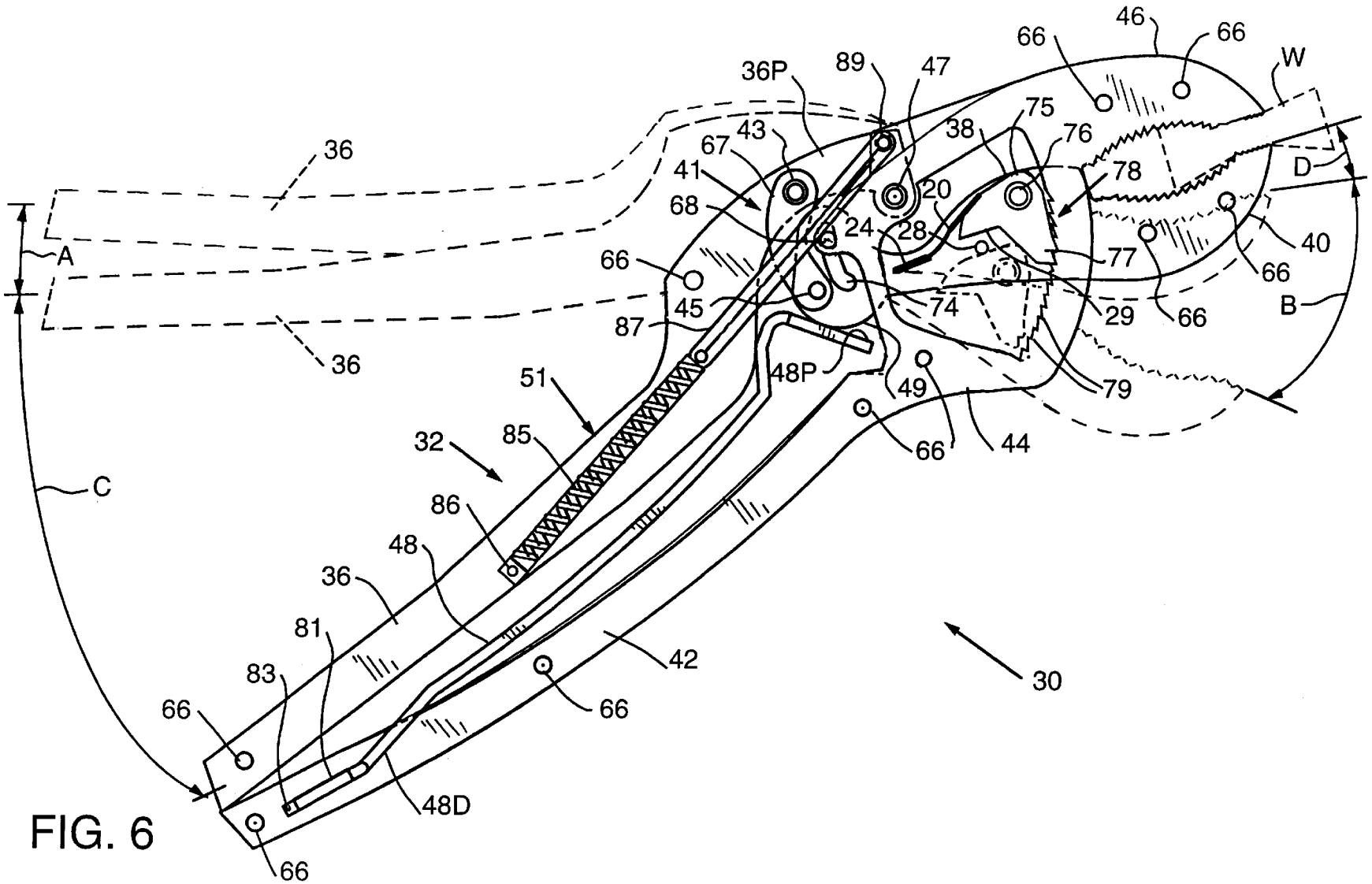
FIG. 6 is a further side elevational view of the pliers shown in FIGS. 4 and 5 with the pliers being operated to augment the initial grasping force applied to the workpiece.

Referring specifically to FIGS. 4–6, the operation of the pliers 30 will be described in detail. Specifically, FIG. 4 shows the pliers 30 in a fully opened position with the handle portions 36 and 42 being at the farthermost point away from each other and the jaw portions 40 and 46 being at the farthermost point away from each other. As described, the spring means 51 serves to maintain the pliers 30 in the fully open position. The pivot pin 68 is positioned in the shifting slot portion 74 of the positioning slot 70 while the pliers 30 are in the fully opened position. The pivot pin 68 is also positioned in the shifting slot portion 74 of the positioning slot 70 when the handle portions 36 and 42 are initially moved toward each other in response to the user squeezing the handle portions 36 and 42 to initially grasp the workpiece W. The leaf spring 48 acts against the bearing surface 49 to bias the pivot pin 68 to remain in the shifting slot portion 74 of the positioning slot 70. During this movement of the handle portions 36 and 42 toward each other and the jaw portions 40 and 46 toward each other, the pivot pin 68 acts as the active pivot point of the pliers 30.

While the pliers 30 are in the fully opened position (see FIG. 4), the bias of the leaf spring 48 against the bearing surface 49 on the intermediate portion 38 of the first plier member 36 in cooperation with the pawl stop pin 28 and spring 20 serves to maintain the pawl 75 in concentric alignment with and out of engagement with the rack 78. As long as the pivot pin 68 remains positioned in the shifting slot portion 74 of the positioning slot 70, the pawl 75 remains spaced apart from and disengaged from the rack 78. As the handle portions 36 and 42 are moved toward each other, the jaw portions 40 and 46 also move toward each other resulting in the pawl 75 moving upward at a relatively spaced distance from the rack 78. During this initial movement, the pivot pin 68 remains positioned in the shifting slot portion 74 of the positioning slot 70 and the pivot pin 68 continues to act as the active pivot point of the pliers 30.

Referring to FIG. 5, initial movement of the handle portions 36 and 42, and more specifically movement of the handle portion 36 toward the handle portion 42, is illustrated. Due to the structure of the link means 41 and its being pivotally interconnected to the handle portion 36 by pin 43 and also being pivotally interconnected to the intermediate portion 38 by pin 45, movement or angular displacement, as indicated by arrow A, of handle portion 36 results in the movement or angular displacement of the jaw portion 40, as indicated by arrow B. This movement is also accomplished by a proximal end 36P of the handle portion 36 being pivotally interconnected by pin 47 to the intermediate portion 44 of the second plier member 34. It will be appreciated that the angular displacement A during this initial adjustment is less than the angular displacement B. During this initial adjustment the pivot pin 68 acts as the active pivot of the pliers 30, as described.

Referring to FIG. 6, continued movement of the handle portion 36 toward the handle portion 42 results in the augmenting the initial grasping force being applied to the workpiece W. Specifically, once the jaw portions 40 and 46 grasp the workpiece W and apply the initial grasping force thereto (see FIG. 5), continued convergence of the handle portions 36 and 42 results in the link means 41 rotating the intermediate portion 38 and the jaw portion 40 of the first plier member 32. In addition, engagement of the jaw portions 40 and 46 with the workpiece W and the continued movement of the handle portion 36 toward the handle portion 42 results in the active pivot of the pliers shifting from the pivot pin 68 to the pivot pin 76 which mounts the pawl 75, which at this stage of the operation is seated into full engagement with the rack 78. Continued movement of the handle portion 36 toward the handle portion 42 results in the pivot pin 68 moving into the generally arcuate portion 72 of the positioning slot 70 against the bias of the leaf spring 48. The pivot pin 68 will continue to move upward within the generally arcuate portion 72 of the positioning slot 70 as the handle portion 36 is moved closer to the handle portion 42 during compression of the workpiece W.

FIG. 6 shows the handle portion 36 at the end of the stroke for augmenting the initial grasping force applied to the workpiece W. In addition, jaw portions 40 and 46 are shown as applying the maximum compression to the workpiece W. Following the initial movement of the handle portion 36 toward the handle portion 42 to apply the initial grasping force to the workpiece W (see FIG. 5), the movement or angular displacement, as indicated by arrow C, of the handle portion 36 results in the movement or angular displacement, as indicated by arrow D, of jaw portion 40. It will be appreciated that during this stage of operation to augment the initial grasping force applied to the workpiece W the angular displacement C is greater than the angular displacement D.

In operation of the pliers 30 of the invention, it will be appreciated that the first plier member 32 and the second plier member 34 are coupled such that the handle portions 36 and 42 and the jaw portions 40 and 46 converge on a workpiece at different angular rates in order to self-adjust and apply an initial grasping force to a workpiece and at different angular rates to provide for augmenting of the initial grasping force applied to the workpiece. Initially, the handle portions 36 and 42 need to converge toward each other only slightly in order to cause the jaw portions 40 and 46 to travel very rapidly from the fully open to the position where the jaw portions 40 and 46 are in engagement with the workpiece and applying a grasping force thereto. Next, the structure of the pliers 30 allows for the rate of convergence of the jaw portions 40 and 46 to be much less than the rate at which the handle portions 36 and 42 converge, therefore providing for the augmenting of the initial grasping force applied to the workpiece and magnifying the gripping force of the pliers 30.

As described, one of the essential features of the invention that allows for the various angular rates of convergence between the handle portions 36 and 42 and the jaw portions 40 and 44 is the indirect connection between the handle portion 36 and the intermediate portion 38 provided by the link means 41. Once the jaw portions 40 and 46 contact the workpiece W and apply the initial grasping force thereto, continued movement of the handle portion 36 toward the handle portion 42 causes the link members 67 and 69 to rotate the intermediate portion 38 and the jaw portion 40 of the first plier member 32 and augment the initial grasping force applied to the workpiece W. The amount of force augmentation is dictated by the geometry of pivot points in relation to jaws 40, 46 and positioning slot 70. For example, the angular movement of jaw 40 when initially grasping a workpiece W can be accelerated in relation to the angular movement of the handle 36 by moving the pin 45 which mounts the link members 67 and 69 to the intermediate portion 38 closer to the shifting slot portion 74 of the positioning slot 70. However, this will also increase the effort required to move the handle 36. Similarly, moving pin 43 which mounts link members 67, 69 to handle 36 closer to pin 47 which mounts handle 36 to intermediate member 44 tends to decrease movement of the jaw 40 in relation to movement of the handle 36 when applying additional grasping force to the workpiece W to increase force augmentation. In addition, the length of the link members 67, 69 and the distance from pivot point 76 at which the handle 36 is attached to intermediate member 44, helps to further determine the degree of force augmentation. Generally, there is a trade off situation where achieving more rapid initial closure of the jaw 40 when adjusting the jaw 40 to initially grasp a workpiece also requires greater initial hand force but also permits a greater amount of force augmentation to be achieved with the remaining range of handle movement. Specific applications will benefit from different geometric relationships among the above-mentioned elements.

As described, the leaf spring 48 engages the bearing surface 49 formed on the intermediate portion 38 of the first plier member and biases the pivot pin 68 toward the shifting slot portion 74 of the positioning slot 70. The leaf spring 48 is structured to exert constant upward pressure against the bearing surface 49 at the point of contact therewith. During the continued movement of the handle portion 36 toward the handle portion 42 to apply the force augmentation, the leaf spring 48 is deflected downward as the pivot pin 68 moves upward from the shifting slot portion 74 into the generally arcuate portion 72 of the positioning slot 70. The leaf spring 48 adds a minimal amount of back pressure against the handle portions 36 and 42. The leaf spring 48 assists to move the handle portions 36 and 42 and the jaw portions 40 and 46 to the fully open position once hand pressure is removed from the pliers 30. The leaf spring 48 also ensures that the pivot pin 68 returns to the shifting slot portion 74 of the positioning slot 70 following operation of the pliers 30.

Figure 7:
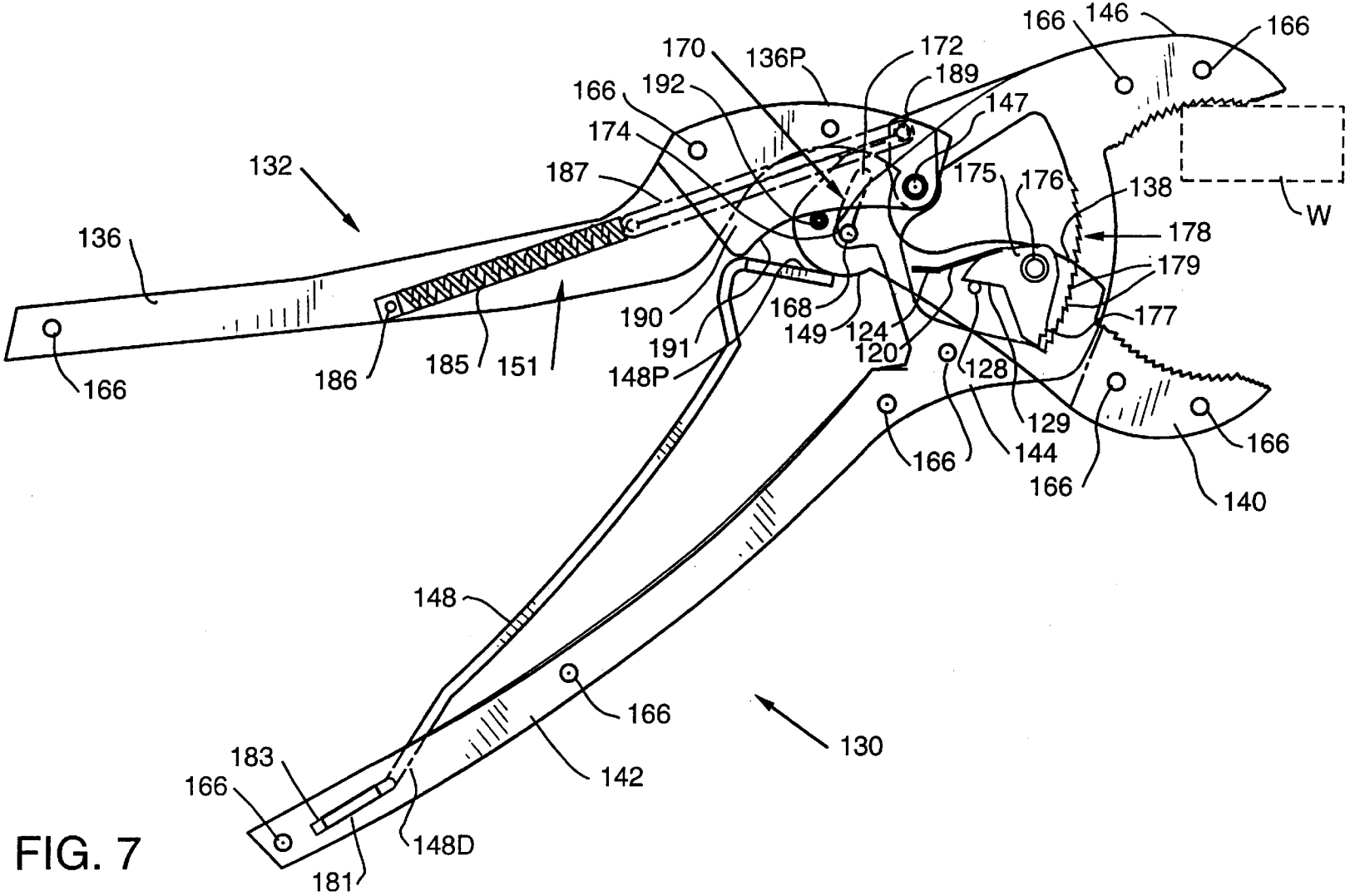
FIG. 7 is a simplified side elevational view of a further embodiment of the invention, showing the pliers in a fully open position.
Figure 8:
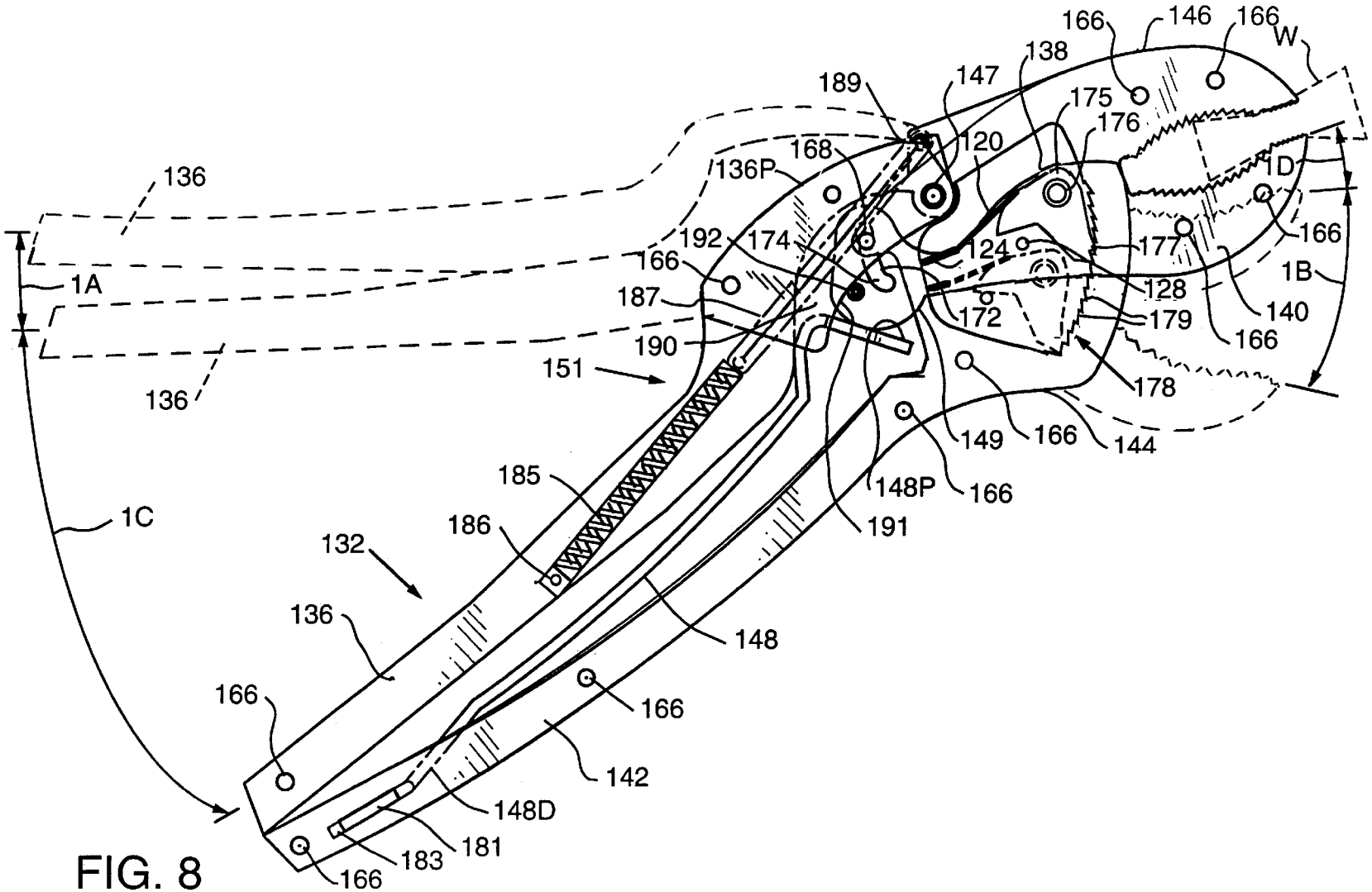
FIG. 8 is a further side elevational view of the pliers shown in FIG. 7 with the pliers being operated to augment the initial grasping force applied to the workpiece.

Referring to FIGS. 7 and 8 there are shown simplified side elevational views of a further embodiment of the invention. FIG. 7 illustrates pliers 130 in a fully open position while FIG. 8 illustrates the pliers 130 with the pliers 130 being operated to augment the initial grasping force applied to the workpiece W. As described herein for pliers 30, the pliers 130 are capable of applying an initial grasping force to the workpiece W and augmenting the initial grasping force applied to the workpiece W. It will be understood that the pliers 130 are similar in structure to the pliers 30, as described in detail herein, and that similar components have like reference numbers preceded by a "1". The similarities will be apparent to one of ordinary skill in the art following a review of FIGS. 7 and 8.

The essential difference between the pliers 130 and the pliers 30 is that the link means 41 of the pliers 30 has been eliminated. For pliers 130, the handle portion 136 of the first plier member 132 is formed separately from the intermediate portion 138 of the first plier member 132. More specifically, the handle portion 136 of the first plier member 132 includes an integrally formed extension 190 which includes cam means, as will be described in more detail herein, for cooperating with cam follower means, which will also be described in more detail herein, formed on the intermediate portion 138 of the first plier member 132. The cam means and the cam follower means cooperate with the first pivot, namely the pivot pin 168 which is received in the positioning slot 170 (as described in detail herein for the previous embodiment), for applying a grasping force to the workpiece W. The cam means and cam follower means also cooperate with the second pivot means, namely the pawl 175 and the rack 178 (as described herein for the previous embodiment), for augmenting the grasping force applied to the workpiece W.

The cam means includes a cam surface 191 formed on the extension 190 adjacent the intermediate portion 138 of the first plier member 132. The cam follower means includes a cam follower 192 on the intermediate portion 138 positioned generally adjacent the shifting slot portion 174 of the positioning slot 170. The cam surface 191 is positioned for cooperation with the cam follower 192.

Still referring to FIGS. 7 and 8, the operation of the pliers 130 will be described in detail. As stated, FIG. 7 shows the pliers 130 in a fully opened position with the handle portions 136 and 142 being at the farthermost point away from each other and the jaw portions 140 and 146 also being at the farthermost point away from each other. As in the previously described embodiment, the spring means, generally designated by reference numeral 151, serves to maintain the pliers 130 in the fully open position. The pivot pin 168 is positioned in the shifting slot portion 174 of the positioning slot 170 while the pliers 130 are in the fully opened position. The pivot 168 is also positioned in the shifting slot portion 174 when the handle portions 136 and 142 are initially moved toward each other in response to the user squeezing the handle portions 136 and 142 to grasp the workpiece W. The leaf spring 148 acts against the bearing surface 149 to bias the pivot pin 168 to remain in the shifting slot portion 174. During this initial movement of the handle portions 136 and 142 toward each other and the jaw portions 140 and 146 toward each other, the pivot pin 168 acts as an active pivot of the pliers 130.

Movement of the handle portions 136 and 142, and more specifically movement of the handle portion 136 toward the handle portion 142, results in the movement or angular displacement, as indicated by arrow 1A, of handle portion 136 and also results in the movement or angular displacement of the jaw portion 140, as indicated by arrow 1B. It will be appreciated, as described in detail for the previous embodiment, that the angular displacement 1A during this initial adjustment is less than the angular displacement 1B.

Referring more specifically to FIG. 8, continued movement of the handle portion 136 toward the handle portion 142 results in the augmentation of the initial grasping force being applied to the workpiece W. Specifically, once the jaw portions 140 and 146 initially grasp the workpiece W and apply the initial grasping force thereto, continued convergence of the handle portions 136 and 142 results in the cam surface 191 cooperating with the cam follower 192 to rotate the intermediate portion 138 and the jaw portion 140 of the first plier member 132. In addition, engagement of the jaw portions 140 and 146 with the workpiece W and the continued movement of the handle portion 136 toward the handle portion 142 results in the active pivot of the pliers shifting from the pivot pin 168 to the pivot pin 176 which mounts the pawl 175. Continued movement of the handle portion 136 toward the handle portion 142 results in the pivot pin 168 moving into the generally arcuate portion 172 of the positioning slot 170.

Shown in solid line in FIG. 8 is the position of the pliers 130 at the end of the stroke for augmenting the initial grasping force applied to the workpiece W. Jaw portions 140 and 146 are shown as applying the maximum compression to the workpiece W. Following the initial movement of the handle portion 136 toward the handle portion 142 to apply the initial grasping force to the workpiece W, the continued movement or angular displacement, as indicated by arrow 1C, of the handle portion 136 results in the movement or angular displacement, as indicated by arrow 1D, of jaw portion 140. It will be appreciated that during this stage of operation to augment the initial grasping force applied to the workpiece W, the angular displacement 1C is greater than the angular displacement 1D.

In operation of the pliers 130, it will be appreciated that the first plier member 132 and the second plier member 134 are coupled such that the handle portions 136 and 142 and the jaw portions 140 and 146 converge on a workpiece at different angular rates in order to self-adjust and apply the initial grasping force to a workpiece and at different angular rates to provide for augmenting of the initial grasping force applied to the workpiece. Initially, the handle portions 136 and 142 converge toward each other only slightly in order to cause the jaw portions 140 and 146 to travel the full distance from fully open to the position where the jaw portions 140 and 146 are in engagement with the workpiece W and applying the initial grasping force thereto. Next, during continued convergence of the handle portions 136, 142, the structure of the pliers 130 allows for the rate of convergence of the jaw portions 140 and 146 to be much smaller than the rate at which the handle portions 136 and 142 converge, therefore providing for the augmenting of the initial grasping force applied to the workpiece and magnifying the gripping force of the pliers 130.

Figure 9:
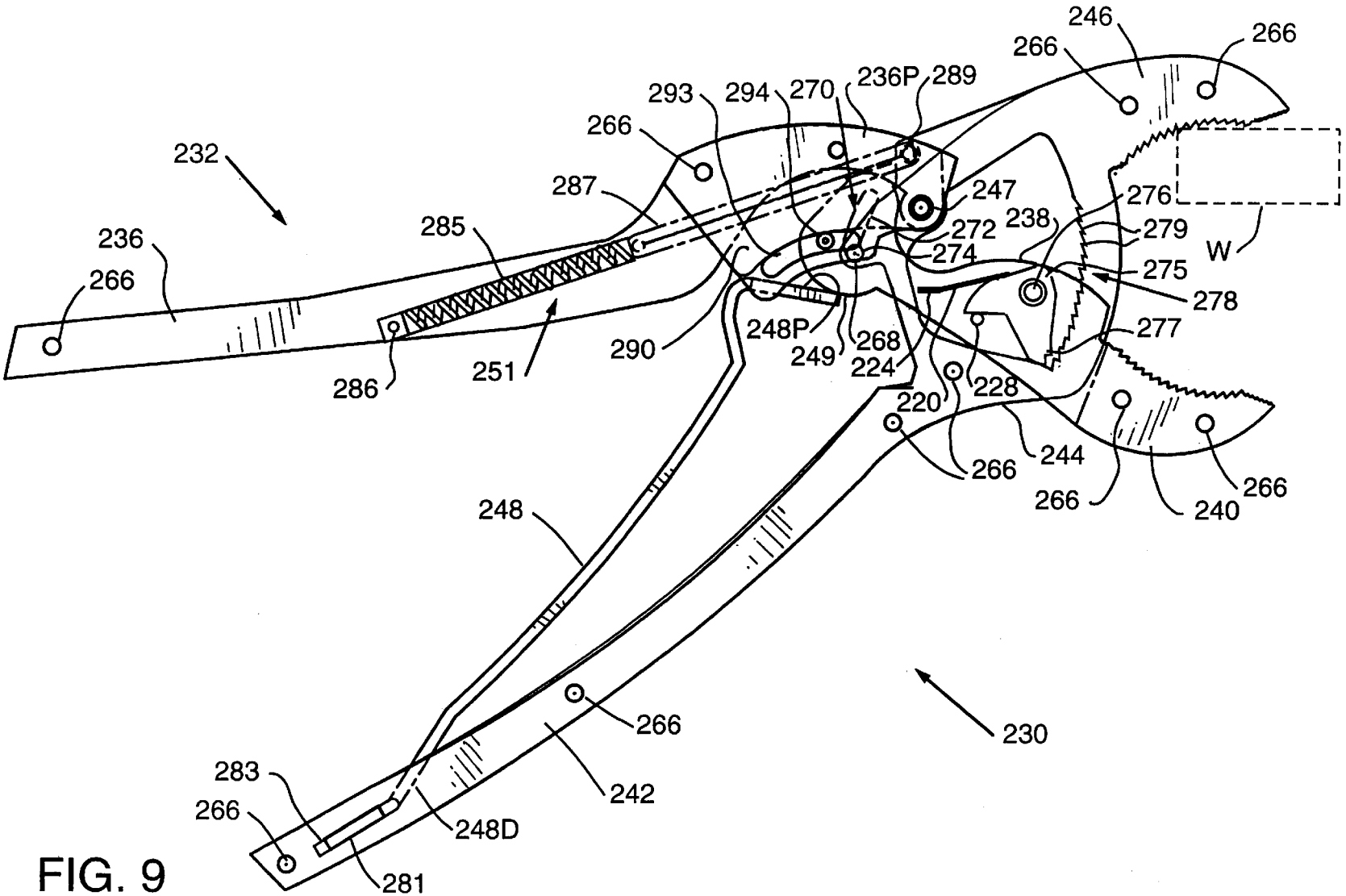
FIG. 9 is a simplified side elevational view of a further embodiment of the invention, showing the pliers in a fully open position.
Figure 10:
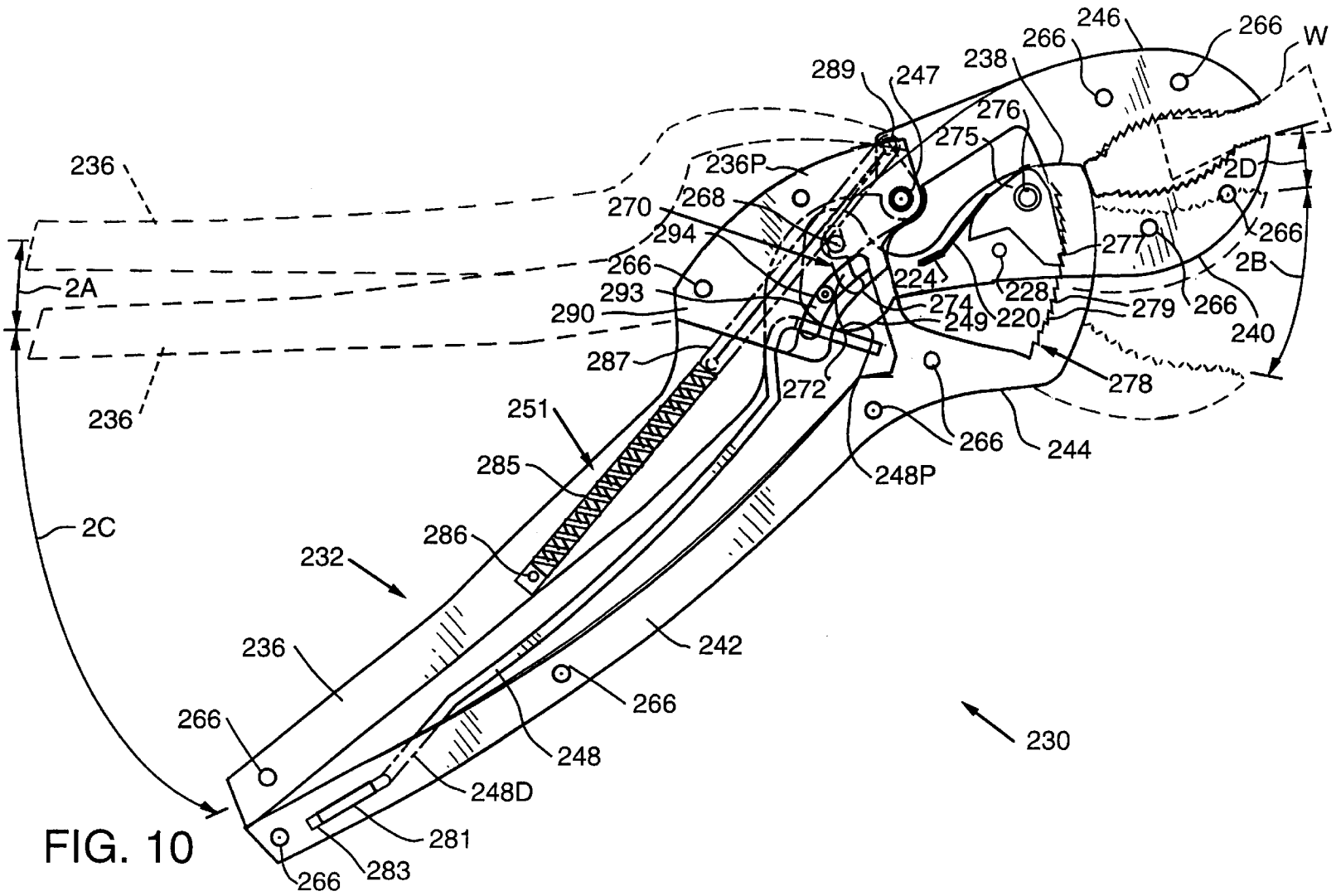
FIG. 10 is a further side elevational view of the pliers shown in FIG. 10, with the pliers being operated to augment the initial grasping force being applied to the workpiece.

Referring to FIGS. 9 and 10, there are shown simplified side elevational views of yet a further embodiment of the invention. FIG. 9 illustrates pliers 230 in a fully open position while FIG. 10 illustrates the pliers 230 with the pliers 230 being operated to augment the initial grasping force applied to the workpiece W. It will be understood that the pliers 230 are similar in structure to the pliers 30 and 130, as described in detail herein and that similar components include like reference numbers preceded by a "2". The similarities will be apparent to one of ordinary skill in the art following a review of the Figures appended hereto.

Specifically, pliers 230 operate in essentially the same manner as pliers 130. However, rather than employing the cam surface 191 and the cam follower 192, pliers 230 include a cam slot 293 formed in the extension 290 that is integrally formed with the handle portion 236 of the first plier member 232. A cam follower or cam pin 294 is formed on the intermediate portion 238 of the first plier member 232 adjacent the positioning slot 270. As shown, the cam follower or cam pin 294 is received in and moveable within the cam slot 293. Similar to the embodiment shown in FIGS. 7 and 8 and described herein, convergence of the handle portions 236 and 242 results in the cam pin 294 cooperating with the cam slot 293 to rotate the intermediate portion 238 and the jaw portion 240 of the first plier member 232.

FIG. 10 shows the position of the pliers 230 at the end of the stroke for augmenting the initial grasping force applied to the workpiece W. Shown in dotted line is the movement of the handle portions 236 and 242, and more specifically movement of the handle portion 236 toward the handle portion 242, which results in the movement or angular displacement, as indicated by arrow 2A of handle portion 236 and also results in the movement or angular displacement of the jaw portion 240, as indicated by arrow 2B. It will be appreciated, as described in more detail for the previous embodiments, that the angular displacement 2A during this initial adjustment is less than the angular displacement 2B. Following the initial movement of the handle portion 236 toward the handle portion 242 to apply the initial grasping force to the workpiece W, the movement or angular displacement, as indicated by arrow 2C, of the handle portion 236 results in the movement or angular displacement, as indicated by arrow 2D, of jaw portion 240. It will be appreciated that during this stage of operation to augment the initial grasping force applied to the workpiece W, the angular displacement 2C is greater than the angular displacement 2D.

Whereas particular embodiments of the present invention have been described herein for purposes of illustration, it will be evident to those skilled in the art that numerous variations of the details may be made without departing from the invention as defined in the appended claims.

What is claimed is:

1. Pliers with self-adjustment capability for applying an initial grasping force to a workpiece and for augmenting the initial grasping force applied to the workpiece comprising:

a first plier member including a handle portion, a jaw portion, an intermediate portion, and a link member interconnecting the handle portion of said first plier member to the intermediate portion of said first plier member;

a second plier member including a handle portion, a jaw portion, an intermediate portion therebetween and a generally arcuate rack formed on said intermediate portion thereof;

a first pivot having a positioning slot with a generally arcuate portion and a shifting slot portion formed in said intermediate portion of said first plier member and a pivot member formed on said second plier member, said pivot member being movable within said positioning slot, said first pivot permitting said jaw portions to converge in response to initial movement of said handle portions toward each other for applying the initial grasping force to the workpiece;

a second pivot defined by locking surfaces formed on said generally arcuate rack and a rack engaging structure connected to said first plier member, said second pivot permitting further convergence of said jaw portions in response to continued movement of said handle portions toward each other for augmenting the initial grasping force applied to the workpiece;

said rack engaging structure being out of engagement with said locking surfaces of said generally arcuate rack while said jaw portions converge on the workpiece during said initial movement of said handle portions towards one another, said rack engaging structure moving into engagement with said locking surfaces of said generally arcuate rack in response to said continued movement of said handle portions toward each other; and a first biasing spring structured to bias said pivot member toward said shifting slot portion of said positioning slot, said pivot member being movable from said shifting slot portion toward said generally arcuate portion of said positioning slot against the bias of said first biasing spring during said continued movement of said handle portions toward each other, and wherein movement of said pivot member towards said generally arcuate portion of said positioning slot causes said rack engaging structure to move into engagement with said locking surfaces of said generally arcuate rack so that said second pivot permits the augmenting of the initial grasping force during said continued movement of said handle portions toward each other.

2. The pliers of claim 1 further including a second biasing spring for biasing said handle portions away from each other and said jaw portions away from each other.

3. The pliers of claim 1 wherein said first plier member is structured such that angular displacement of said handle portion of said first plier member is smaller than angular displacement of said jaw portion of said first plier member during said initial movement of said handle portions toward each other and angular displacement of said handle portion of said first plier member is larger than angular displacement of said jaw portion of said first plier member to permit the augmenting of the initial grasping force during said continued movement of said handle portions toward each other.

4. The pliers of claim 3 wherein said intermediate portion of said first plier member includes a bearing surface, said first biasing spring acting against said bearing surface to bias said pivot member toward said shifting slot portion of said positioning slot.

5. The pliers of claim 4 wherein said bearing surface is generally arcuate and has a curvature generally centered about a center point of said pivot member when said pivot member is positioned in said shifting slot portion of said positioning slot.

6. The pliers of claim 4 wherein said first biasing spring includes a leaf spring having a distal end attached to a distal end of said handle portion of said second plier member and a proximal end for acting against said bearing surface.

7. The pliers of claim 1 wherein said handle portion of said first plier member includes a proximal end pivotally connected to said second plier member adjacent said intermediate portion of said second plier member.

8. The pliers of claim 7 wherein said link member includes a first end and a second end, said first end pivotally connected to said handle portion of said first plier member adjacent said proximal end thereof and said second end pivotally connected to said intermediate portion of said first plier member adjacent said positioning slot.

9. The pliers of claim 1 wherein said link member includes a first end and a second end, said first end pivotally connected to said handle portion of said first plier member and said second end pivotally connected to said intermediate portion of said first plier member such that angular displacement of said handle portion of said first plier member is smaller than angular displacement of said jaw portion of said first plier member during said initial movement of said handle portions toward each other and angular displacement of said handle portion of said first plier member is larger than angular displacement of said jaw portion of said first plier member to permit the augmenting of the initial grasping force during said continued movement of said handle portions toward each other.

10. The pliers of claim 9 wherein said handle portion of said first plier member includes a proximal end pivotally connected to said second plier member adjacent said intermediate portion of said second plier member.

11. The pliers of claim 1 wherein said rack engaging structure includes a pawl member pivotally connected by a pawl pivot pin to said first plier member; and said arcuate portion of said positioning slot has a curvature generally centered about said pawl pivot pin.

12. The pliers of claim 11 wherein said generally arcuate rack has a curvature generally centered about said pivot member of said first pivot.

13. The pliers of claim 1 wherein said first plier member is constructed of laminations stamped from sheet metal.

14. The pliers of claim 1 wherein said second plier member is constructed of laminations stamped from sheet metal.

15. Pliers for applying an initial grasping force to a workpiece and for augmenting the initial grasping force applied to the workpiece comprising:

a first plier member including a handle portion, a jaw portion, an intermediate portion, and means for pivotally interconnecting the handle portion of said first plier member to the intermediate portion of said first plier member;

a second plier member including a handle portion, a jaw portion, and an intermediate portion therebetween;

first pivot means for permitting said jaw portions to converge in response to initial movement of said handle portions toward each other for applying the initial grasping force to the workpiece;

second pivot means for permitting further convergence of said jaw portions in response to continued movement of said handle portions toward each other for augmenting the initial grasping force applied to the workpiece; and first biasing means for acting in cooperation with (a) said first pivot means for applying the initial grasping force to the workpiece and (b) said second pivot means for augmenting the initial grasping force applied to the workpiece.

16. The pliers of claim 15 further including second biasing means for biasing said handle portions away from each other and said jaw portions away from each other.

17. The pliers of claim 15 wherein said first plier member is structured such that angular displacement of said handle portion of said first plier member is smaller than angular displacement of said jaw portion of said first plier member during said initial movement of said handle portions toward each other and angular displacement of said handle portion of said first plier member is larger than angular displacement of said jaw portion of said first plier member to permit the augmenting of the initial grasping force during said continued movement of said handle portions toward each other.

18. The pliers of claim 17 wherein said intermediate portion of said first plier member includes a bearing surface, said first biasing means acting in cooperation with said bearing surface to bias said first pivot means toward a first position.

19. The pliers of claim 18 wherein said first biasing means includes a leaf spring having a distal end attached to a distal end of said handle portion of said second plier member and a proximal end for acting against said bearing surface.

20. The pliers of claim 15 wherein said handle portion of said first plier member includes a proximal end pivotally connected to said second plier member adjacent said intermediate portion of said second plier member.

21. The pliers of claim 20 wherein said means for pivotally interconnecting the handle portion of said first plier member to the intermediate portion of said first plier member includes a link member having a first end and a second end, said first end pivotally connected to said handle portion of said first plier member adjacent said proximal end thereof and said second end pivotally connected to said intermediate portion of said first plier member adjacent said first pivot means.

22. The pliers of claim 15 wherein said first plier member is constructed of laminations stamped from sheet metal.

23. The pliers of claim 15 wherein said second plier member is constructed of laminations stamped from sheet metal.

24. Pliers with self-adjustment capability for applying an initial grasping force to a workpiece and for augmenting the initial grasping force applied to the workpiece comprising:

a first plier member including a handle portion, a jaw portion, an intermediate portion, and a link member interconnecting the handle portion of said first plier member to the intermediate portion of said first plier member;

a second plier member including a handle portion, a jaw portion, and an intermediate portion therebetween;

a first pivot on said intermediate portions permitting said jaw portions to converge in response to initial movement of said handle portions toward each other for applying the initial grasping force to the workpiece;

a second pivot on said intermediate portions permitting further convergence of said jaw portions in response to continued movement of said handle portions toward each other for augmenting the initial grasping force applied to the workpiece;

first biasing means for acting in cooperation with (a) said first pivot for applying the initial grasping force to the workpiece and (b) said second pivot for augmenting the initial grasping force applied to the workpiece; and said first plier member structured such that angular displacement of said handle portion of said first plier member is smaller than angular displacement of said jaw portion of said first plier member during said initial movement of said handle portions toward each other for applying the initial grasping force to the workpiece and angular displacement of said handle portion of said first plier member is larger than angular displacement of said jaw portion of said first plier member to permit the augmenting of the initial grasping force during said continued movement of said handle portions toward each other.

25. The pliers of claim 24 further including second biasing means for biasing said handle portions away from each other and said jaw portions away from each other.

26. The pliers of claim 24 wherein said handle portion of said first plier member includes a proximal end pivotally connected to said second plier member adjacent said intermediate portion of said second plier member.

27. The pliers of claim 26 wherein said link member includes a first end and a second end, said first end pivotally connected to said handle portion of said first plier member adjacent said proximal end thereof and said second end pivotally connected to said intermediate portion of said first plier member adjacent said first pivot.

28. Pliers with self-adjustment capability for applying an initial grasping force to a workpiece and for augmenting the initial grasping force applied to the workpiece comprising a first plier member including a handle portion, a jaw portion, and an intermediate portion, said handle portion of said first plier member formed separately from said intermediate portion of said first plier member;

a second plier member including a handle portion, a jaw portion, and an intermediate portion therebetween;

first pivot means for permitting said jaw portions to converge in response to initial movement of said handle portions toward each other for applying the initial grasping force to the workpiece;

second pivot means for permitting further convergence of said jaw portions in response to continued movement of said handle portions toward each other for augmenting the initial grasping force applied to the workpiece;

said handle portion of said first plier member including an integrally formed extension having cam means for cooperating with cam follower means formed on said intermediate portion of said first plier member, said cam means and said cam follower means cooperating with (a) said first pivot means for applying the initial grasping force to the workpiece and (b) said second pivot means for augmenting the initial grasping force applied to the workpiece; and first biasing means for acting in cooperation with (a) said first pivot means for applying the initial grasping force to the workpiece and (b) said second pivot means for augmenting the initial grasping force applied to the workpiece.

29. The pliers of claim 28 further including second biasing means for biasing said handle portions away from each other and said jaw portions away from each other.

30. The pliers of claim 28 wherein said first plier member is structured such that angular displacement of said handle portion of said first plier member is smaller than angular displacement of said jaw portion of said first plier member during said initial movement of said handle portions toward each other and angular displacement of said handle portion of said first plier member is larger than angular displacement of said jaw portion of said first plier member to permit the augmenting of the initial grasping force during said continued movement of said handle portions toward each other.

31. The pliers of claim 28 wherein said handle portion of said first plier member includes a proximal end pivotally connected to said second plier member adjacent said intermediate portion of said second plier member.

32. The pliers of claim 28 wherein said first pivot means includes a positioning slot formed in said intermediate portion of said first plier member and a pivot member formed on said second plier member, said pivot member being movable within said positioning slot; and said cam follower means includes a cam follower on said intermediate portion of said first plier member adjacent said positioning slot.

33. The pliers of claim 32 wherein said cam means includes a cam surface on said extension for cooperating with said cam follower.

34. The pliers of claim 28 wherein said first pivot means includes a positioning slot formed in said intermediate portion of said first plier member and a pivot member formed on said second plier member, said pivot member being movable within said positioning slot; and said cam follower means includes a cam pin on said intermediate portion of said first plier member adjacent said positioning slot.

35. The pliers of claim 34 wherein said cam means includes a cam slot on said extension, said cam pin movable in said cam slot.

* * * * *